US008079875B2

(12) United States Patent
Ho

(10) Patent No.: US 8,079,875 B2
(45) Date of Patent: Dec. 20, 2011

(54) BATTERY CONNECTOR WITH SERPENTINE CONTACTS

(75) Inventor: Hsin-Tsung Ho, Tu-Cheng (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 240 days.

(21) Appl. No.: 12/480,018

(22) Filed: Jun. 8, 2009

(65) Prior Publication Data

US 2010/0311276 A1 Dec. 9, 2010

(51) Int. Cl.
*H01R 24/00* (2011.01)

(52) U.S. Cl. ..... 439/627

(58) Field of Classification Search ..... 439/627, 439/500, 862

See application file for complete search history.

(56) References Cited

U.S. PATENT DOCUMENTS

| | | | | |
|---|---|---|---|---|
| 6,068,519 | A * | 5/2000 | Lok | 439/660 |
| 6,315,621 | B1 * | 11/2001 | Natori et al. | 439/862 |
| 7,785,150 | B1 * | 8/2010 | Ho | 439/627 |
| 2008/0280196 | A1 * | 11/2008 | Lai | 429/121 |

* cited by examiner

*Primary Examiner* — Vanessa Girardi

(57) ABSTRACT

A battery connector includes an insulating housing, a plurality of conductive terminals, an insulating cover and a shell. A bottom surface of the insulating housing defines a plurality of terminal recesses for receiving the conductive terminals. The conductive terminals are placed in the insulating housing from the bottom surface thereof. The insulating cover is then positioned on the bottom surface to secure the conductive terminals in the corresponding terminal recesses. The shell surrounds the front portion of the insulating housing to hold the insulating cover between the bottom surface of the insulating housing and the shell to prevent the conductive terminals from electrically contacting the shell.

8 Claims, 5 Drawing Sheets

BATTERY CONNECTOR WITH SERPENTINE CONTACTS

BACKGROUND OF THE INVENTION

1. Field of the Invention

The present invention generally relates to a connector, and more particularly to a battery connector.

2. The Related Art

Referring to FIG. 5, a conventional battery connector 5 includes an insulating housing 51 that defines a plurality of terminal recesses 511, each penetrating through a front surface 512 and a bottom surface 513 thereof. A metal shell (not shown) encloses the insulating housing 51 and a plurality of conductive terminals 52 disposed in the corresponding terminal recesses 511. The front of the bottom of each terminal recess 511 forms a supporting beam 514 to connect two opposite sides of the terminal recess 511 for propping the corresponding conductive terminal 52. Each of the conductive terminals 52 has a base portion 521, a contact portion 522 projecting out of the front surface 512 of the insulating housing 51 and an elastic portion 523 elastically connecting the contact portion 522 to the base portion 521.

However, when the battery connector 5 is in assembly, the elastic portion 523 of the conductive terminal 52 needs to be compressed by a tool for making the contact portion 522 cross the supporting beam 514 to stretch out of the insulating housing 51. So the assembly process is relatively complex due to the interference caused by the supporting beam 514. Moreover, the elastic portion 523 of the conductive terminal 52 may deform because of the repeated compressions, and that may cause the elastic portion 523 to electrically contact the metal shell and result in electric leakage.

SUMMARY OF THE INVENTION

An object of the present invention is to provide a battery connector. The battery connector includes an insulating housing, a plurality of conductive terminals disposed in the insulating housing, an insulating cover and a shell. A bottom surface of the insulating housing defines a plurality of terminal recesses, each extending longitudinally to penetrate through a mating front surface of the insulating housing. Each of the conductive terminals includes a base portion, a contact portion, and an elastic portion elastically connecting the contact portion to the base portion. The conductive terminals are placed to the insulating housing from the bottom surface thereof, with the base portion and the elastic portion located in the corresponding terminal recess, and the contact portion located in front of the mating front surface directly. The insulating cover is positioned on the bottom surface of the insulating housing to secure the conductive terminals in the corresponding terminal recesses. The shell surrounds the front portion of the insulating housing to make the insulating cover further located between the bottom surface of the insulating housing and the shell to prevent the conductive terminals from electrically contacting the shell.

As described above, the conductive terminals are assembled into the corresponding terminal recesses without using an external tool, and then the insulating cover is positioned under the insulating housing to ensure that the conductive terminals remain in the corresponding terminal recesses so as to facilitate the assembly process. Moreover, the insulating cover is further located between the conductive terminals and the metal shell so as to avoid the conductive terminals electrically contacting the metal shell.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
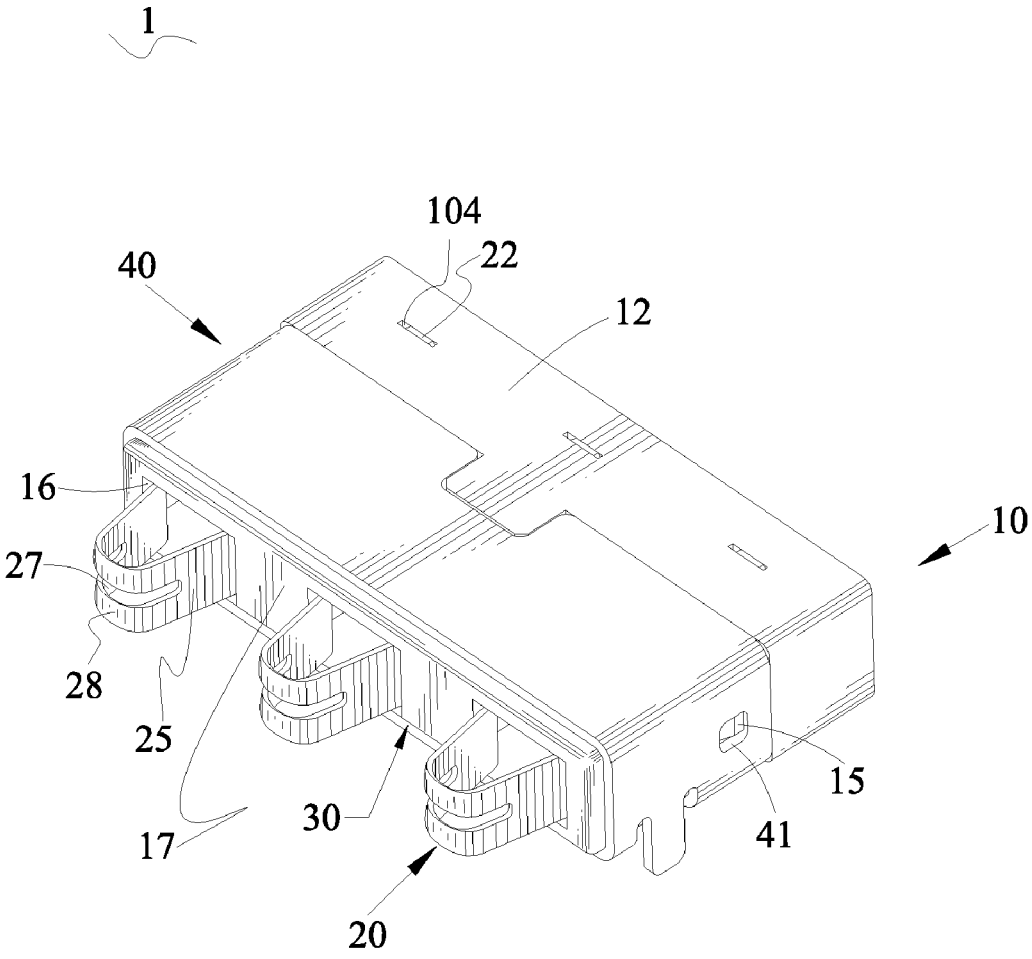
FIG. 1 is a perspective view of a battery connector according to the present invention.
Figure 2:
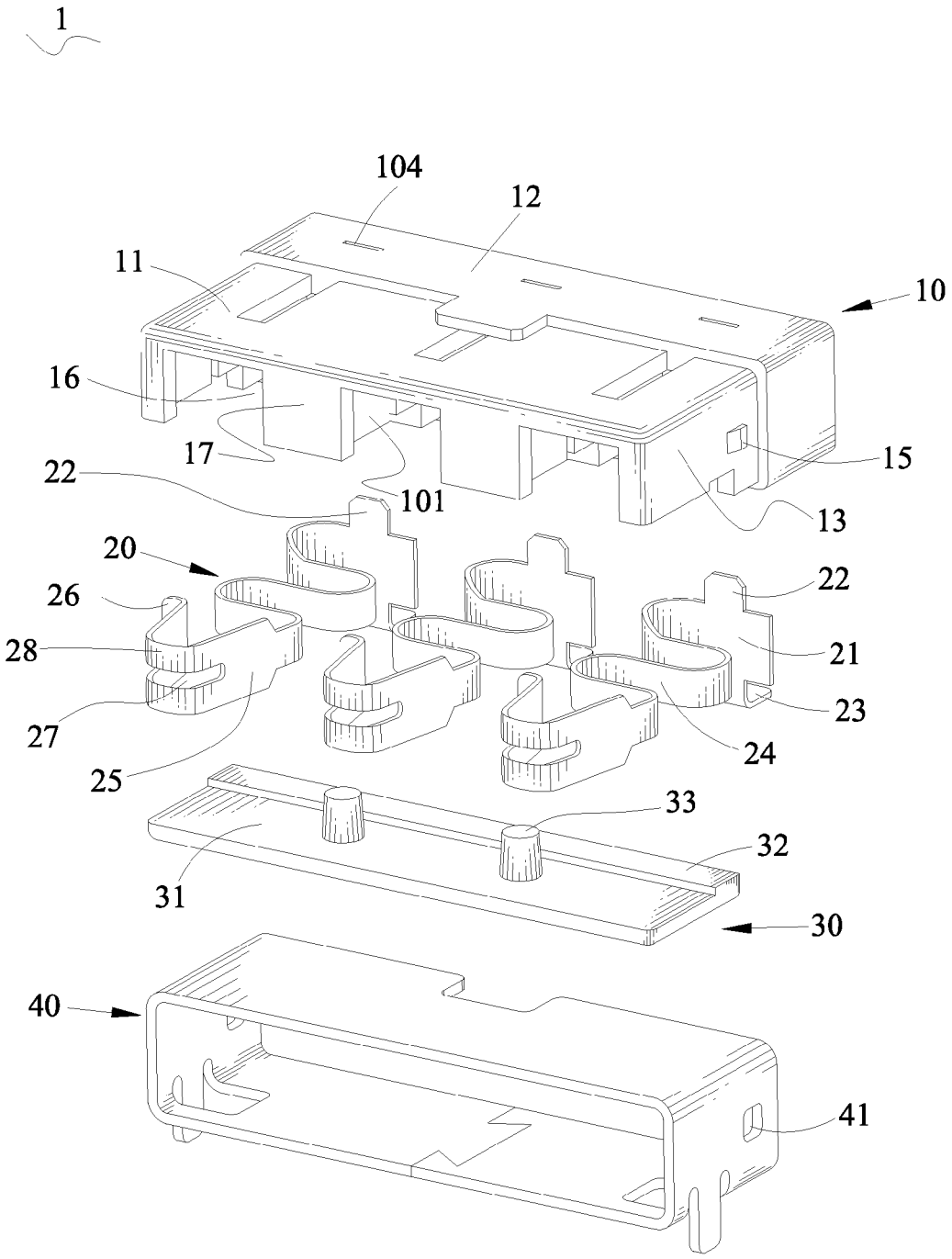
FIG. 2 is an exploded view of the battery connector of FIG. 1.

With reference to FIG. 1 and FIG. 2, a battery connector 1 according to the present invention includes an insulating housing 10, a plurality of conductive terminals 20 disposed in the insulating housing 10, an insulating cover 30 and a metal shell 40.

Figure 3:
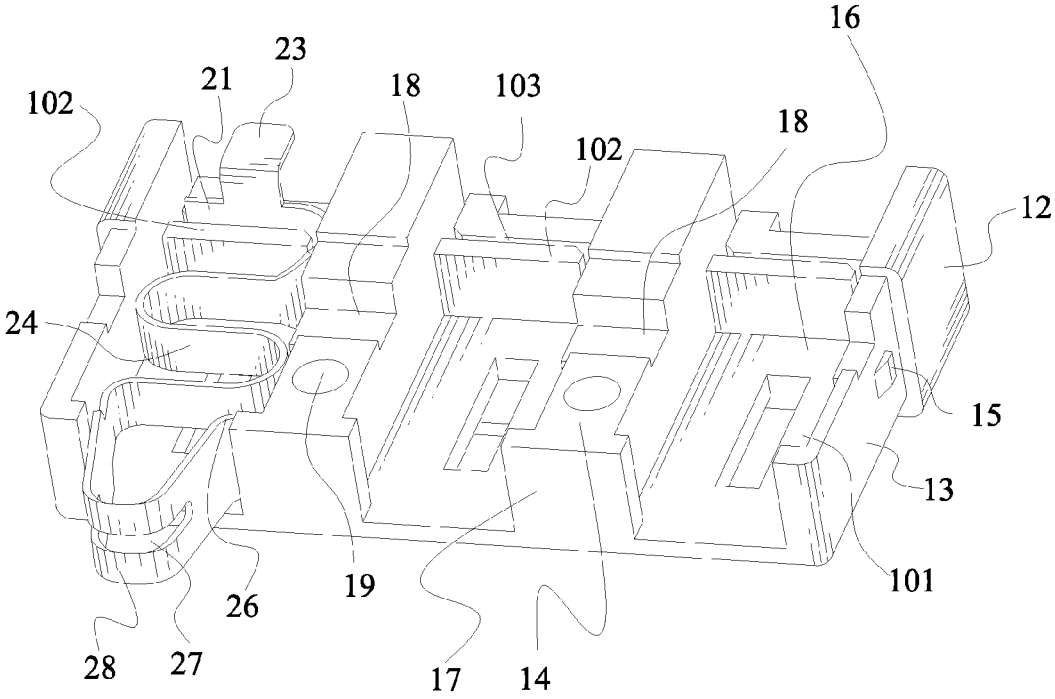
FIG. 3 is a perspective view of an insulating housing of the battery connector of FIG. 1, with one conductive terminal assembled therein.
Figure 4:
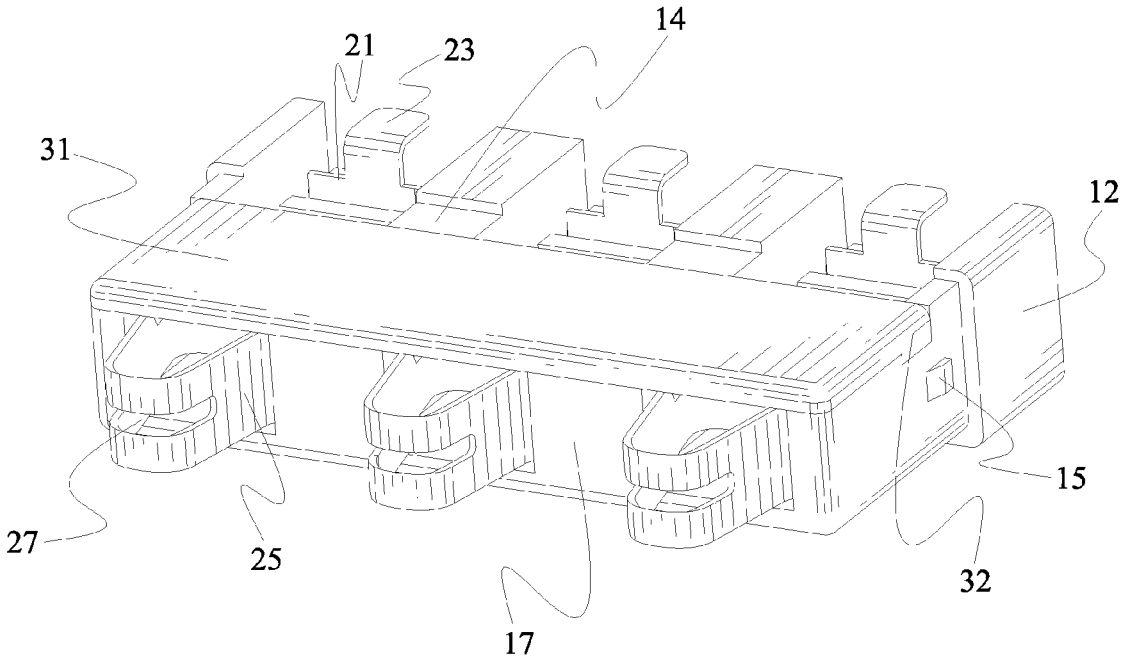
FIG. 4 is a perspective view of the battery connector of FIG. 1 without a metal shell.
Figure 5:
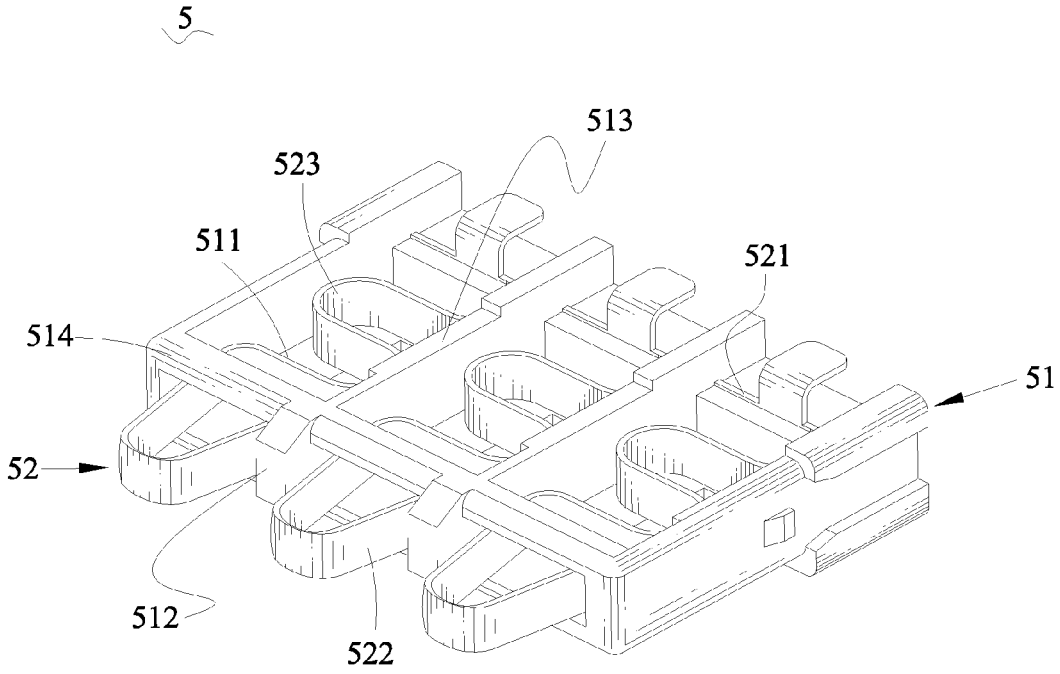
FIG. 5 (Prior Art)
FIG. 5 is a perspective view of a prior battery connector showing a plurality of conductive terminals arranged in an insulating housing.

Referring to FIG. 2 and FIG. 3, the insulating housing 10 has a base body 11 of rectangular shape. A rear part of a top surface of the base body 11 protrudes upward to form a substantially rectangular stopping portion 12 extending transversely to reach to two opposite side surfaces 13 of the base body 11 and further extending to a bottom surface 14 of the base body 11. Each of the side surfaces 13 of the base body 11 protrudes outward to form a holding lump 15 spaced from the stopping portion 12. The base body 11 defines a plurality of rectangular terminal recesses 16 arranged at regular intervals along a transverse direction thereof and each extending longitudinally to penetrate through the bottom surface 14 and a mating front surface 17 thereof. A substantial middle of the bottom surface 14 of the base body 11 is provided with a fixing groove 18 extending transversely to cross the terminal recesses 16 and communicating with the terminal recesses 16. The bottom surface 14 of the base body 11 further defines a plurality of positioning holes 19 in front of the fixing groove 18. A front of each of the terminal recesses 16 extends sideward to form a locating notch 101 and a top side thereof protrudes downward into the terminal recess 16 to form a preventing board 102 adjacent to a rear wall of the terminal recess 16. A fixing fillister 103 is formed between the preventing board 102 and the rear wall of the terminal recess 16. A middle of the fixing fillister 103 further extends upward to penetrate through the stopping portion 12 to form an inserting slot 104.

Referring to FIG. 2 again, each of the conductive terminals 20 has a base portion 21 of rectangular plate shape. A portion of a top edge of the base portion 21 extends upward to form an inserting portion 22. A bottom edge of the base portion 21 extends downward and is perpendicularly bent to form a soldering portion 23. An end edge of the base portion 21 extends towards an opposite direction to the soldering portion 23 to form an elastic portion 24 with a substantially serpentine shape. A free end of the elastic portion 24 further extends to form a contact portion 25 of lying-V shape with an opening facing the elastic portion 24. A free end of the contact portion 25 is bent outward to form a propping portion 26. A slit 27 is provided across a bent portion of the contact portion 25 to divide the contact portion 25 into two contact points 28 so as to ensure a steady connection between the battery connector 1 and a battery (not shown).

Referring to FIG. 2 again, the insulating cover 30 has a rectangular flat base board 31. A rear end of the base board 31 protrudes upward to form a fixing portion 32 extending transversely. A middle of the base board 31 protrudes upward to form a plurality of positioning portions 33 of cone shape in front of the fixing portion 32.

Referring to FIG. 2 again, the metal shell 40 is of rectangular ring shape by a front view. Two opposite sides of the metal shell 40 define a pair of holding apertures 41 passing therethrough and facing each other.

Referring to FIGS.1-4, in assembly, the elastic portion 24 of each of the conductive terminals 20 is disposed in the corresponding terminal recess 16 of the insulating housing 10. The contact portion 25 stretches out of the mating front surface 17 of the insulating housing 10 to contact the battery by means of the two contact points 28. The propping portion 26 is located in the corresponding locating notch 101 for restraining the contact portion 25. The base portion 21 is fixed in the corresponding fixing fillister 103 of the insulating housing 10. The inserting portion 22 is secured into the corresponding inserting slot 104 so as to fasten the conductive terminal 20 in the insulating housing 10 firmly. The soldering portion 23 is exposed from the bottom of the insulating housing 10 to be soldered with a printed circuit board (not shown). The insulating cover 30 is positioned under the insulating housing 10 to seal up the bottom of the terminal recesses 16 and ensure the conductive terminals 20 are in the corresponding terminal recesses 16. The fixing portion 32 of the insulating cover 30 is held in the fixing groove 18 and the positioning portions 33 are positioned in the corresponding positioning holes 19 so as to ensure a firm engagement between the insulating housing 10 and the insulating cover 30. Then the metal shell 40 surrounds a front portion of the combination of the insulating housing 10, the conductive terminals 20 and the insulating cover 30 to hold the insulating cover 30 between the insulating housing 10 and the metal shell 40 so as to prevent the conductive terminals 20 from electrically contacting the metal shell 40. The holding lumps 15 of the insulating housing 10 are buckled into the corresponding holding apertures 41 so as to form a firm engagement between the insulating housing 10 and the metal shell 40. A front end edge of the stopping portion 12 of the insulating housing 10 is against a rear end edge of the metal shell 40.

As described above, the conductive terminals 20 are assembled into the corresponding terminal recesses 16 without using an external tool and then the insulating cover 30 is positioned under the insulating housing 10 to ensure the conductive terminals 20 are in the corresponding terminal recesses 16 so as to facilitate the assembly process. Moreover, the insulating cover 30 is further located between the conductive terminals 20 and the metal shell 40 so as to avoid the conductive terminals 20 electrically contacting the metal shell 40.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A battery connector, comprising:

an insulating housing, a bottom surface of the insulating housing defining a plurality of terminal recesses each extending longitudinally to penetrate through a mating front surface of the insulating housing;

a plurality of conductive terminals, each of the conductive terminals including a base portion, a contact portion, and an elastic portion elastically connecting the contact portion to the base portion, the conductive terminal being placed in the insulating housing from the bottom surface thereof, with the base portion and the elastic portion located in the corresponding terminal recess, the contact portion located in front of the mating front surface directly;

an insulating cover positioned on the bottom surface of the insulating housing to secure the conductive terminals in the corresponding terminal recesses; and a shell surrounding a front portion of the insulating housing to hold the insulating cover between the bottom surface of the insulating housing and the shell for preventing the conductive terminals from electrically contacting the shell;

wherein each of the terminal recesses extends sideward to form a locating notch, and a free end of the contact portion defines a propping portion located in the corresponding locating notch for restraining the contact portion.

2. The battery connector as claimed in claim 1, wherein a rear portion of the insulating housing opposite the mating front surface defines a stopping portion protruded therearound, and a front end edge of the stopping portion abuts against a rear end edge of the shell.

3. The battery connector as claimed in claim 1, wherein the bottom surface of the insulating housing defines a fixing groove extending transversely to cross the terminal recesses, the insulating cover protrudes upward to form a fixing portion extending transversely to be held in the fixing groove.

4. The battery connector as claimed in claim 3, wherein the bottom surface of the insulating housing further defines a plurality of positioning holes, the insulating cover further protrudes upward to form a plurality of positioning portions positioned in the corresponding positioning holes.

5. The battery connector as claimed in claim 1, wherein the elastic portion is of serpentine shape and the contact portion is of lying-V shape with an opening facing the elastic portion.

6. The battery connector as claimed in claim 5, wherein a slit is provided across a bent portion of the contact portion to divide the contact portion into two contact points.

7. The battery connector as claimed in claim 1, wherein a preventing board is protruded into the corresponding terminal recess of the insulating housing, a fixing fillister is formed between the preventing board and a rear wall of the terminal recess for fastening the base portion of the corresponding conductive terminal therein.

8. The battery connector as claimed in claim 7, wherein each of the fixing fillister further extends upward to form an inserting slot, a portion of a top edge of the base portion extends upward to form an inserting portion secured into the corresponding inserting slot.

* * * * *